US005273571A

United States Patent [19]

Mirchandani et al.

[11] Patent Number: 5,273,571

[45] Date of Patent: Dec. 28, 1993

[54] NONMAGNETIC NICKEL TUNGSTEN CEMENTED CARBIDE COMPOSITIONS AND ARTICLES MADE FROM THE SAME

[75] Inventors: Prakash K. Mirchandani, Troy; Laszlo J. Kastura, Detroit; John W. Friederichs, West Branch, all of

[73] Assignee: Valenite Inc., Troy, Mich.

[21] Appl. No.: 993,792

[22] Filed: Dec. 21, 1992

[51] Int. Cl.[5] ..... C22C 29/02

[52] U.S. Cl. ..... 75/242; 75/228; 75/236; 75/240; 75/243; 428/546

[58] Field of Search ..... 29/182.7; 75/238, 239, 75/204, 136, 241, 229, 240, 236; 419/14; 427/221

[56] References Cited

U.S. PATENT DOCUMENTS 3,771,975 11/1973 Frehr ..... 29/182.7
3,918,138 11/1975 Nemeth et al. ..... 29/182.7
4,265,662 5/1981 Miyake ..... 75/238
4,497,660 2/1985 Lindholm ..... 75/240
4,963,183 10/1990 Hong ..... 75/241

OTHER PUBLICATIONS

Ekmar et al "Nickel as a Binder in WC Based Cemented Carbide" Journal of Refractory and Hard Metals, Mar. 1983.

*Primary Examiner*—Donald P. Walsh
*Assistant Examiner*—J. Greaves
*Attorney, Agent, or Firm*—Bill C. Panagos

[57] ABSTRACT

A nonmagnetic, NiWC cemented carbide composition and articles made from the same. The addition of chromium renders the composition nonmagnetic independent of the free carbon level in the composition. The composition is useful as wear resistant parts in electronic instruments and as punches to deep draw aluminum beverage cans.

2 Claims, 1 Drawing Sheet

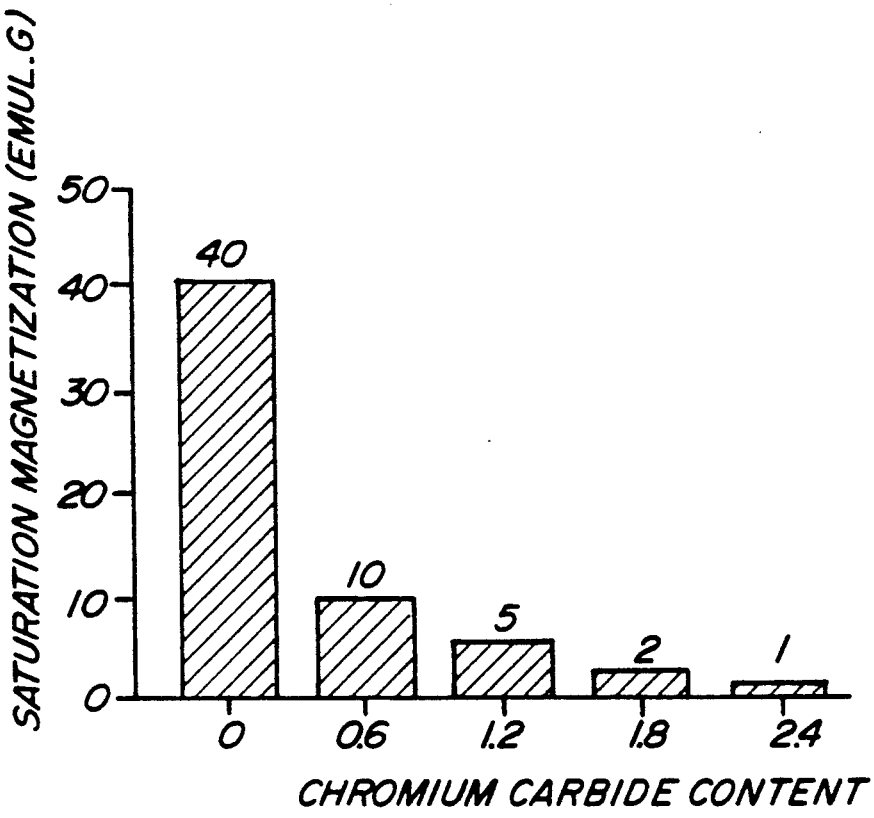
SATURATION MAGNETIZATION (EMUL.G)
50
40
30
20
10
0
40
10
5
2
1
0
0.6
1.2
1.8
2.4
CHROMIUM CARBIDE CONTENT

NONMAGNETIC NICKEL TUNGSTEN CEMENTED CARBIDE COMPOSITIONS AND ARTICLES MADE FROM THE SAME

BACKGROUND OF THE INVENTION

1. Field of the Invention.

The present invention relates to a nonmagnetic nickel tungsten cemented carbide composition which exhibits nonmagnetic properties independent of the free carbon level of the composition.

The present invention further relates to a nonmagnetic nickel tungsten cemented carbide composition which is useful for making wear resistant parts in electronic instruments.

The present invention further relates to a nonmagnetic nickel tungsten cemented carbide composition which is useful for making punches to deep draw aluminum beverage cans.

2. Description of the Related Art.

Nemeth et al., U.S. Pat. No. 3,918,138 describes compositions for producing nonmagnetic cemented carbides based upon Ni binders. In general, Ni is the least magnetic among the ferromagnetic elements. Ni-binder cemented carbides are thus usually "weakly" magnetic. Nemeth '138 adds Ti to render the Ni-binder cemented carbides completely nonmagnetic. The drawback to Ti addition is a that Ti is a very strong carbide former, and hence Ti addition will invariably de-carburize the WC present in the cemented carbide. This may lead to the formation of highly undesirable brittle eta-phase by forming Ni2W4C. Thus, a carbon lean condition is a prerequisite for obtaining nonmagnetic behavior in cemented carbides containing Ti additions. In other words, free carbon cannot be present in nonmagnetic cemented carbides based on Ti additions.

The present invention uses Cr to form nickel tungsten cemented carbide compositions that are nonmagnetic independent of the free carbon level and without forming a brittle eta phase.

Hong, U.S. Pat. No. 4,963,183 discloses a corrosion resistant cemented carbide wherein chromium is added to cemented carbide to enhance corrosion resistance. Hong did not recognize that the addition of chromium affected the magnetic properties of the composition.

Lindholm, U.S. Pat. No. 4,497,660 discloses the addition of Cr to NiWC cemented carbides as a means for improving the corrosion resistance of such hard metal carbides. Nowhere does Lindholm recognize the ability of chromium to affect the magnetic behavior of Ni WC cemented carbides.

Ekemar et al., "Nickel as a Binder in WC-Based Cemented Carbides" *Journal of Refractory and Hard Metals*, Mar. 1983, is an article directed to the use of chromium to provide corrosion resistance to Ni WC cemented carbide compositions. There is no showing of the use of Cr in Ni WC cemented carbide compositions to affect the magnetic properties of it.

SUMMARY OF THE INVENTION

The present invention relates to a nickel tungsten cemented carbide composition and articles made therefrom which has a nonmagnetic behavior independent of the free carbon level of the composition. The composition comprises from about 60 to about 98 percent by weight of a carbide of the elements selected from the group consisting of Group IVB, Group VB, Group VIB of the periodic table, and mixtures thereof, from about 0.2 to about 4.0 percent by weight chromium; and the balance nickel.

The composition further includes up to about 4.0 percent by weight alloying elements selected from the group consisting of molybdenum, copper, aluminum, silicon and mixtures thereof. When an alloying element is present in an amount of up to 1percent by weight of the composition, the alloying element may be selected from the group consisting of copper, aluminum, silicon and mixtures thereof. The composition may posses a free carbon level as high as CO6 as measured by ASTM procedure B 276–79. It is surprising that the amount of chromium necessary to render the composition nonmagnetic decreases as the level of free carbon decreases. Indeed, no brittle eta phase is created by carbon depletion of the WC. The composition exhibits a non magnetic behavior which is defined as a saturation magnetization in the range of less than or equal to 5 emu/g.

FIG. 1 is a graph showing the saturation magnetization of the sintered samples as a function of Cr3C2 content.

DETAILED DESCRIPTION OF THE PREFERRED EMBODIMENTS

The present invention is a nickel tungsten cemented carbide composition which has a nonmagnetic behavior independent of the of the free carbon level of the composition. The composition is comprised of from about 60 to about 98 percent by weight of a carbide of the elements selected from the group consisting of Group IVB, Group VB, Group VIB of the periodic table, and mixtures; thereof from about 0.2 to about 4.0 percent by weight chromium; and the balance nickel. The composition optionally further includes up to about 4.0 percent by weight of an alloying element selected from the group consisting of molybdenum, copper, aluminum, silicon and mixtures thereof. Preferably, the alloying element is molybdenum. However, the alloying element may also be selected from the group consisting of copper, aluminum, silicon and mixtures thereof, present in amounts up to about 1 percent by weight of the composition. The composition of the present invention exhibits nonmagnetic properties even when the free carbon level is as high as CO6 as measured by ASTM procedure B 276–79.

It has been discovered that the amount of chromium necessary to render the composition nonmagnetic decreases as the level of free carbon decreases.

The composition of the present invention is considered to exhibit non magnetic behavior when it has a saturation magnetization in the range of less than or equal to 5 emu/g, and preferably, approaching 0 emu/g.

The composition of the present invention is very useful in a situation where a non magnetic material is necessary. For example, the present invention is well suited for wear parts useful in electronic applications, and further as punches to deep draw aluminum cans where the punch, if it acquired magnetism, would interfere with electronic sensors. This property allows an operator to automate the can manufacturing process without fear of shut down due to sensor failure.

As can be seen in FIG. 1, the saturation magnetization of NiWC cemented carbides as a function of chromium carbide declined as the amount of chromium carbide added was increased.

Those skilled in the art recognize that the following examples are illustrative of various aspect of the invention and many modifications will be apparent without departing from the scope and spirit of the invention.

EXAMPLES

Sintered Ni-WC based cemented carbide samples were prepared using means well known to those of ordinary skill in the art. The following Ni-WC based cemented carbide samples are given in percent by weight. All samples were prepared in the same manner using standard cemented carbide technology involving milling of powder blends, consolidation and vacuum sintering.

TABLE 1

| |
|---|
| (1) 12% Ni, 0.1% C, balance WC |
| (2) 12% Ni, 0.1% C, 0.6% Cr3C2, balance WC |
| (3) 12% Ni, 0.1% C, 1.20% Cr3C2, balance WC |
| (4) 12% Ni, 0.07% C, 1.80% Cr3C2, balance WC |
| (5) 12% Ni, 0.07% C, 2.40% Cr3C2, balance WC |

As indicated above, the Cr in the samples was introduced through Cr3C2 additions. Those skilled in the art recognize that Cr additions can also be made via elemental Cr additions, or by the use of master alloys containing Cr. The Cr percentage in the above samples 1 through 5 was roughly 0. 0.5%, 1.0%, 1.5% and 2.0% respectively. The sintered samples were prepared via ball milling of powder blends, consolidation of the milled powder, followed by vacuum sintering. Deliberate carbon additions were made to demonstrate that nonmagnetic behavior could be achieved even in the presence of free carbon.

TABLE 2

The following samples were prepared in the same manner as those of Table 1. The free carbon level measured according to ASTM procedure B276-79.

| Composition | Free Carbon Level |
|---|---|
| (1) 12% Ni, 0.1% C, WC balance | CO1 |

TABLE 2-continued

The following samples were prepared in the same manner as those of Table 1. The free carbon level measured according to ASTM procedure B276-79.

| Composition | Free Carbon Level |
|---|---|
| (2) 12% Ni, 0.1% C, 0.6% Cr3C2, WC Balance | CO4 |
| (3) 12% Ni, 0.1% C, 1.8% Cr3C2, WC Balance | CO4 |
| (4) 12% Ni, 0.07% C, 1.8% Cr3C2, WC Balance | CO6 |
| (5) 12% Ni, 0.07% C, 2.4% Cr3C2, WC Balance | CO6 |

Table 2 shows that all samples retained a significant levels of free carbon. Each sample retained a nonmagnetic nature in spite of the free carbon level in the sample. In particular, sample 5 was essentially non magnetic in spite of the relatively high free carbon level.

We claim:

1. A nickel tungsten cemented carbide composition which has a nonmagnetic behavior independent of the free carbon level of the composition, comprising:
   from about 60 to about 98 percent by weight of a carbide of the elements selected from the group consisting of Group IVB, Group VB, Group VIB of the periodic table, and mixtures therof;
   from about 0.2 to about 4.0 percent by weight chromium;
   and the balance nickel;
   wherein the amount of chromium necessary to render the composition nonmagnetic decreases as the level of free carbon decreases.

2. An article of a nickel tungsten cemented carbide composition having a nonmagnetic behavior independent of the free carbon level of the composition, comprising:
   from about 60 to about 98 percent by weight of a carbide of the elements selected from the group consisting of Group IVB, Group VB, Group VIB of the periodic table, and mixtures therof;
   from about 0.2 to about 4.0 percent by weight chromium;
   and the balance nickel;
   wherein the amount of chromium necessary to render the composition nonmagnetic decreases as the level of free carbon decreases.

* * * * *